United States Patent [19]

Miller et al.

[11] 3,999,314

[45] Dec. 28, 1976

[54] SMALL SUB-GRADER

[75] Inventors: David J. Miller; Charles P. Miller, both of McHenry, Ill.

[73] Assignee: Miller Formless Co., Inc., McHenry, Ill.

[22] Filed: Nov. 5, 1975

[21] Appl. No.: 629,023

[52] U.S. Cl. ..... 37/108 R; 172/4; 37/DIG. 20; 404/84; 172/26

[51] Int. Cl.[2] ..... E02F 5/00

[58] Field of Search ..... 37/108 R, 108 A, DIG. 4, 37/15, 20; 172/4.5, 4, 26, 779, 803, 804, 807; 404/84

[56] References Cited

UNITED STATES PATENTS

| | | | |
|---|---|---|---|
| 3,029,716 | 4/1962 | Shea | 404/84 |
| 3,246,406 | 4/1966 | Ray, Jr. | 172/804 |
| 3,423,859 | 1/1969 | Swisher, Jr. et al. | 404/84 X |
| 3,452,461 | 7/1969 | Hanson | 37/108 X |
| 3,606,827 | 9/1971 | Miller et al. | 404/84 |
| 3,637,026 | 1/1972 | Snow | 172/4.5 |
| 3,749,504 | 7/1973 | Smith | 404/84 |
| 3,822,751 | 7/1974 | Waterman | 172/804 X |
| 3,914,064 | 10/1975 | Gurries | 404/84 |

FOREIGN PATENTS OR APPLICATIONS

| | | | |
|---|---|---|---|
| 243,707 | 5/1965 | Austria | 172/803 |
| 1,386,853 | 3/1975 | United Kingdom | 404/84 |

*Primary Examiner*—E. H. Eickholt
*Attorney, Agent, or Firm*—Bruce K. Thomas

[57] ABSTRACT

The rotating cutting tool of a sub-grader is adjustably mounted transverse the front of the frame of the machine upon a tool support in a manner which isolates changes in grade from changes in slope and which minimizes the influence of changes in slope upon the grade of the tool. The transverse pivot axis for grade control of the tool support is located at an intermediate point on the main frame, while the cutting tool, its associated drive means and housing are mounted on an independent pivot axis for slope control that extends longitudinally on one side of the main frame. Any changes made in the grade are accomplished by raising and lowering the entire tool support on the transverse axis equally at both ends which does not alter the slope of the tool. The arc of movement is relatively long so that the change in fore and aft altitude of the tool is minimal. The rotating tool is maintained perpendicular to and in the plane of its longitudinal slope control axis by the tool frame. However, any changes in slope are entirely independent of the grade deviations and the tool is maintained in a desired plane at all times.

4 Claims, 7 Drawing Figures

SMALL SUB-GRADER

BACKGROUND OF THE INVENTION

The prior art teaches a number of ways of automatically leveling the main frame of a construction machine during its advance along a grade, at a pre-determined and accurately held plane and height regardless of variations in the grade, slope or height of the ground being traversed. The prior art also teaches a number of ways of automatically leveling the working tool of a construction machine under the foregoing conditions. The means by which these results are accomplished and the accuracy of the end product of course vary as much as the number of teachings. The U.S. Pat. Nos. 3,249,026, 3,280,846, 3,292,511, 2,761,666, 3,710,695 and 3,606,827 are exemplary of these teachings and each has its advantages and disadvantages.

One of the problems facing the construction machine art has been the accurate control of the slope and grade of a working tool as the machine negotiates a path of travel over a rough grade. Various forms of suspension have been used between the working tool and the main frame of the machine or between the main frame, carrying a fixed tool, and the ground engaging means used to transport the machine. Machines of this type employ working tools that extend transversely of the main frame either in front of the frame, at a mid-point of the frame or at the rear of the frame. If the frame is adjusted in relation to the wheels or tractors and the tool is fixed to the frame then the location and number of supporting wheels and frame adjusting points become critical to the accurate control of the system.

Generally it is easier to maintain three suspension points in a plane than it is to maintain four suspension points in a plane. Attempts have been made to use large flexible frames to carry rigidly attached working tools and support the four corners of the frame on adjustable suspension means over a wheel or tractor at each corner. In this arrangement a grade reference on each side of the machine is required and the slope is determined by the co-planar relationship of the grade reference.

In order to eliminate one grade line, which has several known advantages, it is necessary to control the pair of suspension means on that side in a manner to maintain the required slope or level of the working tool. This is done by operating that pair of suspension means simultaneously from a gravity operated sensor to raise and lower that side of the frame.

The prior art machines fall into a number of categories: (a) those that employ large flexible frames and four corner supports between the frame and the ground engaging means, (b) those that employ rigid frames either three or four supports between the frame and the ground engaging means, and (c) those that employ either flexible or rigid frames and adjustably support the tool in relation to the frame, using relatively rigid supports between the frame and the ground engaging means. It is apparent that the larger heavy machines, such as those which span one or more lanes of a highway, are easier to control and produce an end product meeting the accepted standards of grade and slope than smaller machines which because of their dimensions are subject to greater deviations in negotiating and correcting for given changes in grade, slope or level. In both large and small machines the working tool can be carried transverse the frame or longitudinal of the frame at various locations and the tool can be on either side of the main frame or in the so-called straddle position. Some machines are versatile enough to tolerate any type of tool mounting.

The art recognizes that the problems associated with frame and tool adjustment to control grade and slope for these purposes are not related, and the teachings from one art are not necessarily applicable to another. Likewise the suspensions used for a transverse tool do not translate into something useful for a side-mounted working tool. Thus a side-mounted tool such as illustrated by the Cheney U.S. Pat. No. 3,292,511 requires a vertical adjustment for height or grade control, a gravity responsive tilt correction and a pitch or grade correction. In the Cheney device, a change in pitch influences the height of the tool and a change in tilt.

Such construction machines include as their basic parts a main frame used to support one or more working tools; ground engagement or traction means such as wheels, skids or endless tracks, and various kinds of adjustable support means between the main frame and the ground engagement means or between the main frame and the working tool. The ground engagement means are in direct rolling or sliding contact with grade (the elevation), slope (the inclination); and the surface conditions encountered differ widely. Their common objective is to utilize adjustable frame or tool support means to maintain the frame and tool at a predetermined plane reflecting as near as possible a desired grade and slope irrespective of the irregularities of the ground over which the machine passes.

SUMMARY OF THE INVENTION

The invention is based on the use of mechanical means to isolate grade and slope corrections of a working tool from each other. A tool support is provided across the front of the machine. The tool support has a pair of rearwardly extending arm members that are located along the sides of the frame and are pivoted thereto on a common transverse axis. The forward ends of the arm members are supported from a frame extension by a pair of extendible members that operate in unison to raise and lower the tool support in an arc of relatively long radius about the transverse axis. The working tool is supported from the tool support by a single extensible member connected between the tool support and a central point of the working tool and also by a longitudinal pivot axis at one end of the working tool. This longitudinal pivot axis is located in the proximity of the grade reference or the so-called inboard side of the machine.

Thus the simultaneous operation of the pair of extensible members raises and lowers the tool support, the working tool, and its longitudinal axis support as a unit without changing the angular relationship of the working tool (the slope) in relation to the frame support. The operation of the single extensible member rotates the working tool in relation to the tool support without causing a significant change in grade as established by the pair of extensible members since the longitudinal pivot axis is contiguous to or in line with the grade reference.

The machine steers by articulation of the frame between the front and rear pairs of ground engaging means on which the machine travels.

DESCRIPTION OF THE DRAWINGS

Illustrative embodiments of the invention are shown in the drawings wherein.

DESCRIPTION OF THE PREFERRED EMBODIMENTS

Figure 1:
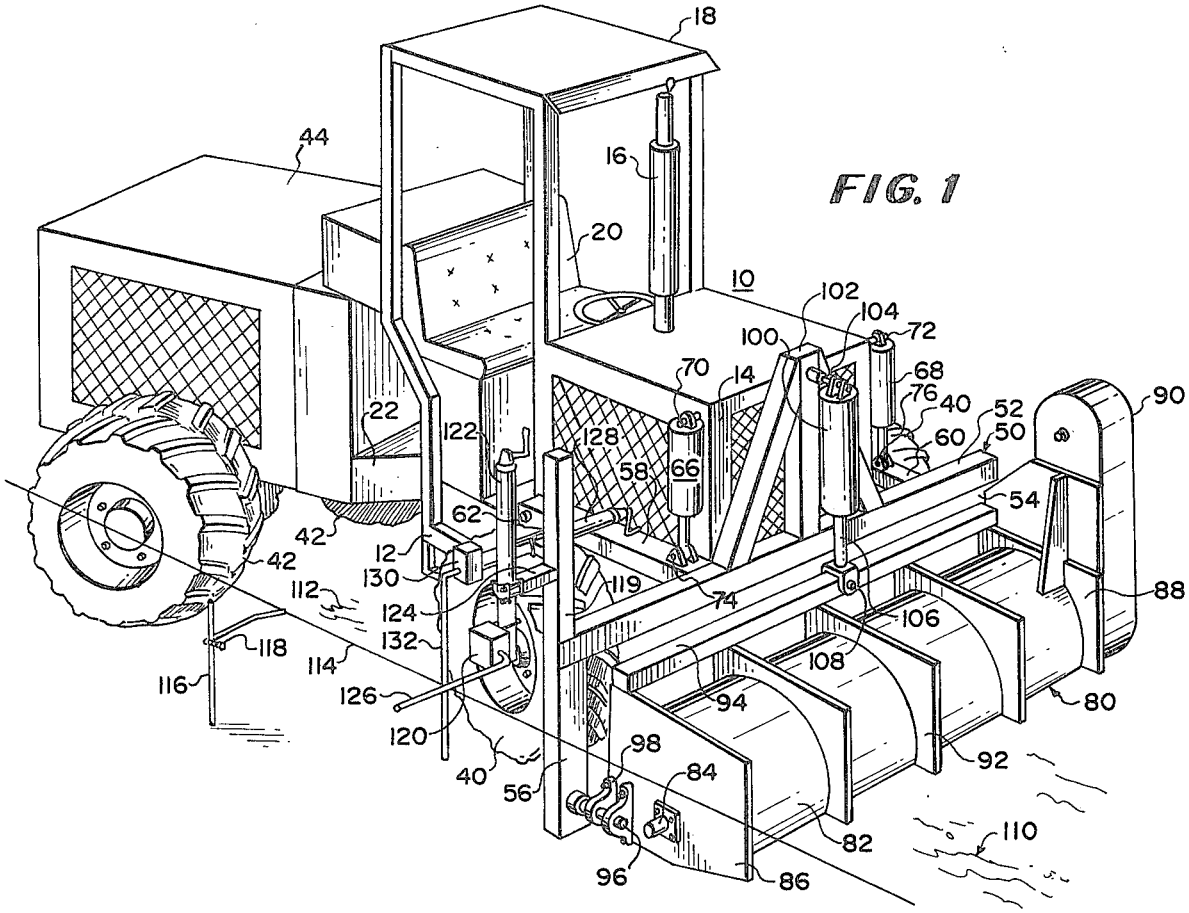
FIG. 1 is an isometric view of a machine carrying the tool support means of this invention.
Figure 2:
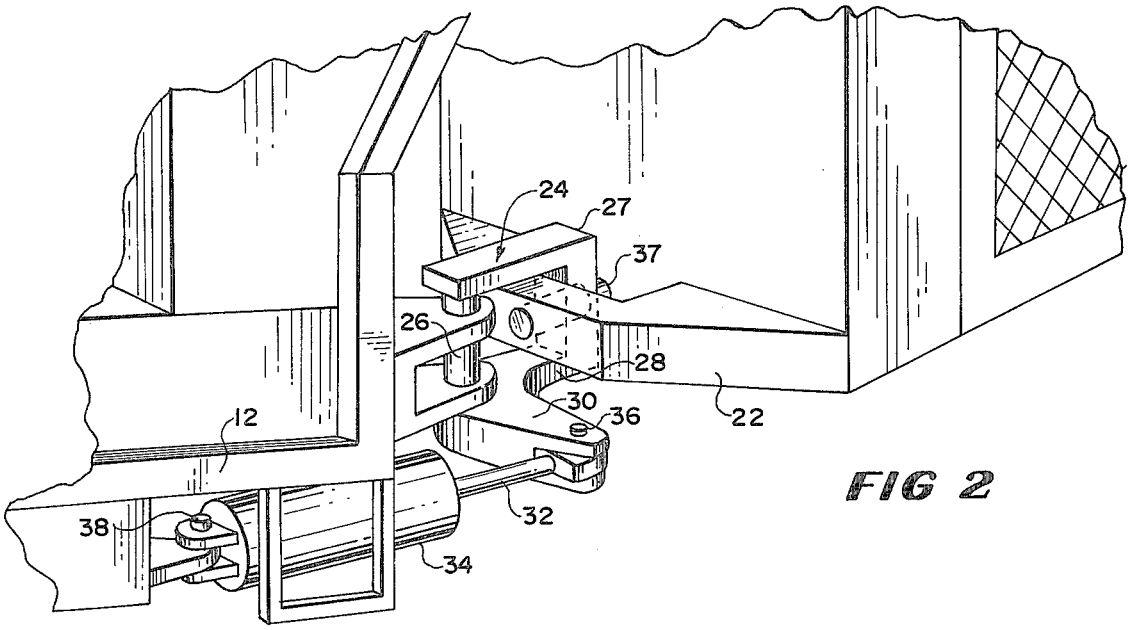
FIG. 2 is a fragmentary enlarged view of the frame articulation and steering means for the machine shown in FIG. 1.

Referring to the drawings, particularly FIGS. 1, and 2, the machine 10, illustrated by a Vermeer Model 475 four wheel drive tractor manufactured by Vermeer Mfg. Corp., includes the front rigid frame section 12 which has the rigid auxillary frame members 14 defining a housing for the prime mover, the muffler therefore being illustrated at 16. Aft of the frame 12 and integral therewith is the canopy 18 and drivers seat 20. The housing portion for the prime mover is of low profile so the driver can check the operation of the machine at all times.

The frame 12 (See FIG. 2) is connected to the rear frame section 22 by means of the heavy duty universal joint 24 wherein these parts are pivotally connected to the pin 26 through the yoke member 27 in a manner known in the art. The lower arm 28 of the yoke 27 has a side arm 30 to which the rod 32 of the ram 34 is pivotally connected at the pin 36. The rear frame 22 is also pivoted on a second axis defined by the pin 37 oriented in the yoke at 90° to the axis of the pin 26 for full universal action, that is, allowing the front and rear frame sections to rotate on the axis 37 so that the wheels can negotiate obstructions on the grade. The other end of the ram 34 is pivotally connected to the frame 12 by means of the pin 38. The hydraulic lines leading to and from the ram 34 are omitted for simplicity.

Each frame part 12 and 22 carries a pair of rubber tired drive wheels, indicated by the front drive wheels 40 and the rear drive wheels 42, all driven in synchronism from the prime mover from a single transmission providing separate drive shafts (not illustrated) connected thereto through fixed axle differential units. The pairs of wheels 40 and 42 are fixed through their axles to the respective frame sections 12 and 22 there being no springs or other suspension means there between.

It is obvious that the extension and retraction of the ram 34 will cause the frame parts 12 and 22 supported as they are on their separate pairs of wheels to articulate in a horizontal plane about the pin 26. Also as each wheel negotiates a change in the grade it is free to raise or lower as the case may be. This type of universal joint is of very rugged construction and only allows the frame parts these two degrees of movement, there being little or not tendency for the parts to pivot on a transverse axis.

The frame section 12 carries the housing 44 for the gas tank, hydraulic oil tank and the other auxillary equipment for the machine, not involved in this invention except for operability as far as a source of motive power for the drive and hydraulic parts are concerned.

Across the front of the machine the tool support unit 50 is provided to comprise the transverse box beam 52 and a pair of upright rigid side members 54 and 56 affixed to its ends. The beam 52 extends in spaced relationship in front of the frame portion 14 and carries a pair of longitudinal arms 58 and 60 that extend in spaced relationship along the sides of the frame portion 12–14 where they are each attached to the frame by means of the respective pivot pins 62 and 64, (See FIG. 7) aligned transversely of the frame. The arms 58 and 60 are of equal length and coplanar with the beam 52. As before stated the frame section 14 of the Vermeer machine is very rugged allowing its use for the attachment of the pair of rams 66 and 68 by means of the top pivots 70 and 72 and the bottom pivots 74 and 76 attached to the respective side members 58 and 60. Again the hydraulic lines therefore are omitted in FIG. 1 for simplicity. Simultaneous operation of the rams 66 and 68 raises and lowers the tool support means 50 in an arc of relatively long radius about the pivots 62–64.

The working tool 80 is illustrated by an arcuate open-bottom housing 82 which carries therein an auger or cutter supported on the shaft 84 carried between the end plates 86 and 88 upon suitable enclosed bearings of a heavy duty type. A separate motor drive for the tool is carried in the housing 90 at one end (the outboard side) of the housing 82, in this instance a chain drive unit is intended so that the motor therefore can be located above the grade and out of the dust and dirt kicked up by the cutter. This motor is driven hydraulically, and under the control of the operator for stopping, starting and speed adjustment.

The housing 82 is suitably rigidified by the reinforcing plates 92 spaced therealong which are tied together along the back edge by the box beam 94.

The entire working tool 80 with its housing and drive means 90 is pivotally mounted at one end by the pivot pin 96 carried longitudinally of the frame (on the inboard side) and spaced to one side by the upright member 56 of the tool support means 50. The pin 96 is journaled in the pair of cleats 98 affixed to the side plate 86. The working tool 80 is vertically supported at about its center point (transverse the machine) by the single ram 100 which is pivotally attached to the upright support member 102, carried central of the box beam 52 and spaced forward of the frame unit 14, by means of the pivot pin 104 as illustrated. The piston rod 106 of the ram 100 is pivoted to the center or balance point of the entire working tool 80 by means of the pivot pin 108 carried by the box beam 94.

The housing 82 and cross beam 94 are unattached at the end (outboard side) opposite the longitudinal pivot pin 96 but may oscillate in an arc in guided relationship against the forward surface of the vertical beam 54. If desired rollers can be placed therebetween, the purpose being to provide some longitudinal (fore and aft) support for the working tool at this end so that the pivot pins 96 and 108 are under no strain as the tool progresses along and does work upon the rough grade 110.

The cuttings produced by the working tool are conveyed toward the outboard side of the machine and deposited therealong so that the wheels 40 and 42 of the machine travel on the finished grade 112 and the inboard side is clear for the placement of the grade reference line 114 supported by the posts 116 spaced therealong and having the vertically adjustable brackets 118 as are known in this art. If desired the rear top portion of the housing 82 can be open and an endless belt conveyor provided therealong on which the cutter deposites the earth cuttings for conveyance to the inboard side of the machine.

It is clear that the operation of the ram 100 upon the cross pin 108 will raise and lower the working tool 80 upon the pivot pin 96 to make slope adjustments, and the simultaneous operation of the rams 66 and 68 will raise the working tool 80 in a substantially vertical manner to make the grade adjustments.

The upright member 56 is provided with an extension 119 which carries the grade sensor 120 by means of the adjustable hand operated jack 122, upon the side bracket 124 which is also adjustable in relation to the jack. The grade sensor has its sensing arm 126 extending over and in light contact with the top of the grade line 114.

The extension 119 also provides support for the hand operated jack 128, supporting at its end the steering sensor 130. The pendent sensing arm 132 of the steering sensor 130 rides along the inside of the grade line 114.

The purpose of the jacks 122 and 128 is to provide initial manual adjustment of the sensors to bring them into proper position in relation to the grade line 114 while having the rams 66, 68 and 100 at about their mid-points of extension so that maximum travel in each direction is had.

Figure 3:
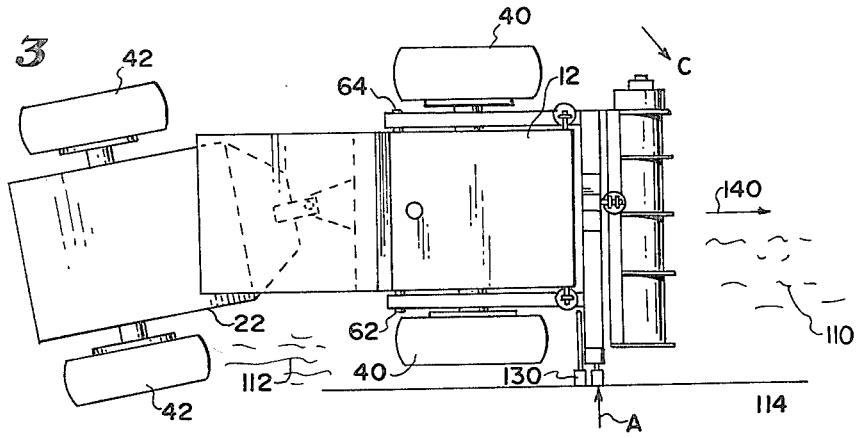
FIG. 3 is a plan view of the machine showing a steering correction to the right.

As previously described, the machine is articulated at the center and steering is performed by the operation of the ram 34. This function is through the servo-valve 132 (FIG. 7) and hydraulic lines 134–136 in a manner known in the art. In FIG. 3 the steering function of the machine is shown during the step of negotiating a right turn as sensed by the steering sensor 130 to turn the front portion of the machine in the direction of the arrow C as the back portion of the machine is turned in the direction of the arrow B by the ram 34, with the machine traveling in the direction of the arrow 140.

Figure 4:
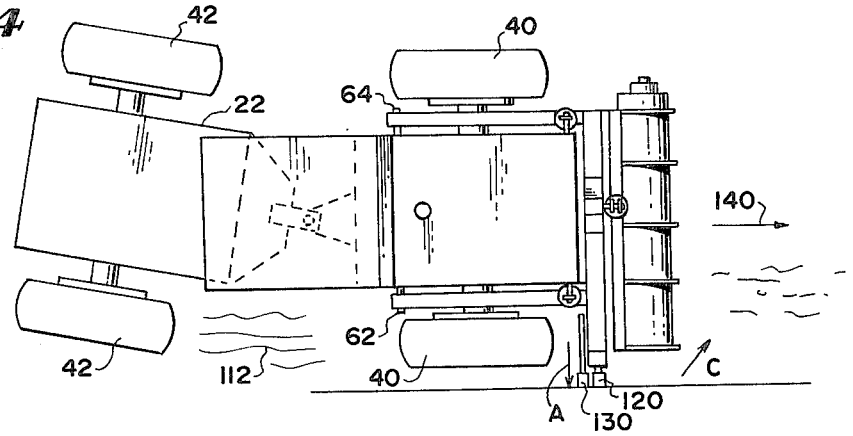
FIG. 4 is a plan view of the machine showing a steering correction to the left.

In FIG. 4 the opposite steering function is being performed wherein the front of the machine is being turned in the direction of the arrow C and the back portion is being turned in the direction of the arrow B under the guidance of the steering sensor 130. In both of these maneuvers the primary swing of the frame parts is in the rear section 22 and the front section 12 remains on a practically straight path.

Figure 5:
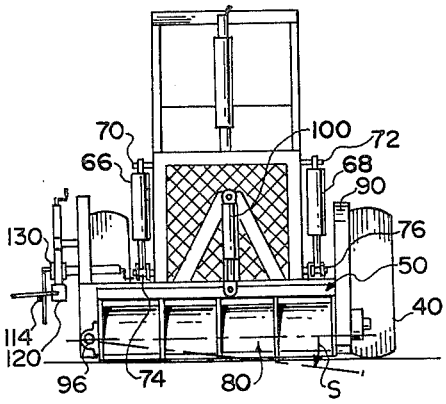
FIG. 5 is a front view of the machine showing a slope correction of amplified magnitude for purposes of illustration.

Referring to FIG. 5 a slope control adjustment is illustrated by the arrow S, being made by the extension of the ram 100 to pivot the tool 80 about the longitudinal axis 96. This function is under the control of the gravity operated slope sensor 142 located central of the frame 12 in a protected position (See FIG. 7) on the frame 12.

Figure 6:
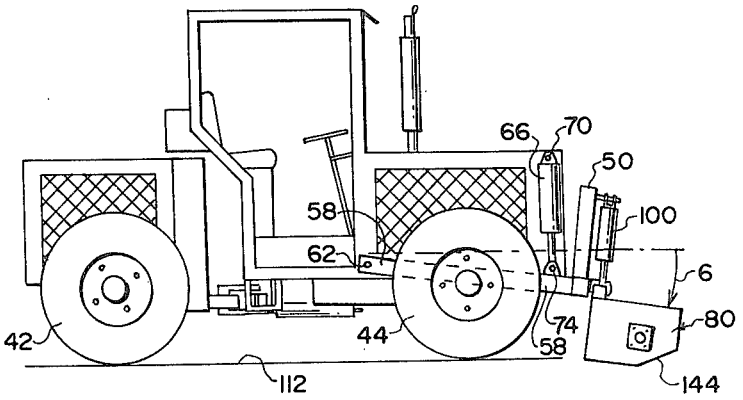
FIG. 6 is a side view of the machine showing a grade correction of amplified magnitude for purposes of illustration.

In FIG. 6 the machine is shown responding to a grade correction as sensed by the grade sensor 120 (not shown), wherein the rams 66 and 68 are operated simultaneously to lower the arms 58 and 60, the tool support unit 50, along with the tool 80, in making a grade adjustment indicated by the arrow G. It is to be noted that the lower forward edge of the housing 80 is beveled at 144 so that it will not dig into the grade during normal grade adjustments.

Figure 7:
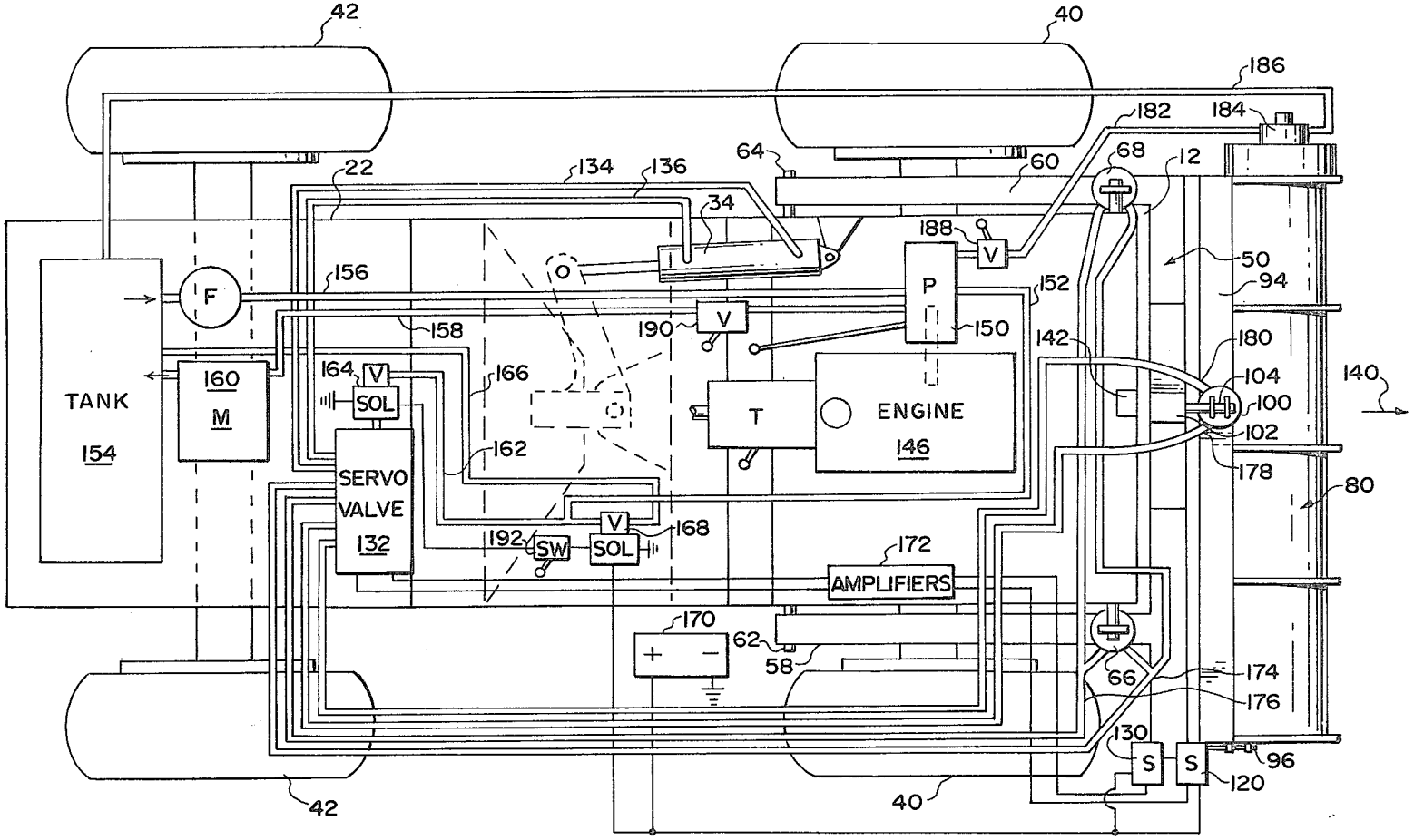
FIG. 7 is a schematic of the control system for the machine also showing the geometry of the suspension.

FIG. 7 illustrates the general geometry of the tool suspension system along with some of the parts for control of the servo-hydraulic system. The engine 146 drives the pump 150 and provides high pressure oil in the line 152 from the supply tank 154, inlet line 156, connected through a filter and return line 158 via the cooler 160. The high pressure oil line 152 leads to the branch line 162 and the solenoid valve 164 supplying the servovalve 132. A second branch line 166 leads back through the solenoid valve 168 to the supply tank 154.

It is apparent that the grade sensor 120 and the steering sensor 130 are suitably connected electrically from the battery 170 through the amplifier 172 for control of the servo valve 132 whereby those portions of the valve 132 are activated to accomplish, respectively, a grade correction by means of the simultaneous operation of the pair of rams 66 and 68 through the pairs of hydraulic lines 174–176 connected by branch lines to the top and bottom of the cylinders of their rams and a slope correction by means of the operation of the ram 100 through the hydraulic lines 178–180.

The pump 150 also supplies high pressure oil through the line 182 to the motor 184 to drive the cutter, and the return line 186 conveys the oil from this motor back to the supply 154. The valve 188 controls the speed of the motor 184 while the valve 190 is the main control valve for all of the hydraulic systems. The main electrical switch for the grade, slope and steering controls is illustrated at 192. The connections for the slope control 142 to the servo-valve 132 are not shown.

In FIG. 7 the geometric relationship of the rams 66 and 68 and the ram 100 to each other and to the tool support 50 and pivots 62–64 is an important consideration as concerns the accuracy and sensitivity of the slope and grade adjustments. The rams 66–68 are located sufficiently ahead of the mid-point between the center line of the pivots 62–64 and behind the center line of the tool so that the upward thrust during working and downward weight of the tool 80 are suitably balanced and the tool in a sense floats along as the machine progresses, there being little actual working forces on these rams during operation. Similarly the ram 100 in addition to being central of the rams 66–68 and ahead of them is at approximately the central balance point of the tool 80 thereby reducing the lateral thrusts that would otherwise be placed upon the longitudinal end pivot 96 or the central pivot 104. During operation the tool 80 practically floats on the pivot 104.

During the operation of the machine the tool 80 tends to maintain the front frame portion 12 in its transverse position along the path of travel, indicated by the arrow 140. When a steering correction is called for by the steering sensor 130 and the ram 34 extends, for example, to make a right hand correction, the rear section 22 of the frame tends to move outwardly from the string line, more than the front section 12 of the machine moves inwardly, or to the right. This is due to the resistance of the tool 80 against twisting in its horizontal plane because of contact with the grade. The reverse action is the same for a left hand steering correction.

Consequently a relatively greater ram movement to accomplish a given steering correction is necessary with the working tool suspended in this manner across the front of an articulated frame than would be required with no tool on the machine. A decided advantage results in that a very small movement of the ram 34 can accomplish a finite direction adjustment within the sensitivity of the steering sensor which can be used to its ultimate capacity without lag or hunting in the system.

The tool naturally offers greater resistance to the hydraulic rams 66 and 68 in making a downward correction (extending) than in making an upward correction (retracting) but the slope adjustments, accomplished by the ram 100 are practically unimpeded in either direction. The extension of the rams 66 and 68 tends to either lower the tool 80 or raise the front wheels 40 from the grade. Since the weight of the machine is far greater than the downward thrust necessary to cause the tool to dig deeper in making a grade adjustment, the geometry of the placement of the rams 66–68 ahead of the axles for the front wheels comes into play by giving the side beams 58 and 60 less lifting leverage than lowering leverage.

What is claimed is:

1. An earth working machine including:

a frame member;

a tool support means extending across the front of said machine, said tool support means including a cross beam;

a pair of transversely spaced rearwardly extending arms affixed to said cross beam;

means pivotally attaching said pair of arms to said main frame rearward of said cross beam along a first transverse axis of said frame member;

means adjustably supporting said arms at an intermediate point for raising and lowering said tool support means about said pivot means;

a working tool carried by said tool support means, said working tool being pivotally attached to said tool support means at one end on a longitudinal pivot axis and having its center line along a second transverse axis across said frame member; and means adjustably supporting and substantially centrally balancing said working tool from said tool support means and adapted to rotate said tool about said longitudinal pivot axis;

said means adjustably supporting said arms being ahead of said first transverse axis of said frame member and sufficiently behind said second transverse axis to establish a balance between the upward working thrust of said tool and its downward weight.

2. An earth working machine in accordance with claim 1 in which:

said frame member has fore and aft portions connected by a universal joint;

a pair of ground engaging means for each of said frame portions;

means to drive said pairs of said ground engaging means in unison; and means to articulate said frame portions about a verticle axis at said universal joint for steering said machine.

3. An earth working machine in accordance with claim 1 in which:

said frame member has fore and aft portions connected by a universal joint behind said first transverse axis;

a pair of ground engaging means for each of said frame portions;

means to drive said pairs of said ground engaging means in unison;

grade sensor means operable to actuate said means adjustably supporting said spaced rearwardly extending arms for control of the grade of said working tool;

slope sensing means operable to actuate said means adjustably supporting said working tool upon said longitudinal pivot axis for control of the slope of said working tool; and steering sensing means operable to actuate said means to articulate said frame portions in relation to each other for control of the steering of said machine;

said grade and steering sensing means being carried by said frame member between said first and second transverse axes and in proximity of said longitudinal pivot axis of said working tool for contact with a grade reference extending therealong.

4. An earth working machine is accordance with claim 1 in which:

said means adjustably supporting said arms comprise a pair of hydraulic rams connected to operate simultaneously for grade control; and said means adjustably supporting said working tool from said frame support comprises a single hydraulic ram connected substantially central of said tool support and at the center of balance of said working tool.

* * * * *

UNITED STATES PATENT OFFICE

CERTIFICATE OF CORRECTION

PATENT NO. : 3,999,314

DATED : December 28, 1976

INVENTOR(S) : DAVID J. MILLER; CHARLES P. MILLER

It is certified that error appears in the above-identified patent and that said Letters Patent are hereby corrected as shown below:

Column 1, line 53, after "frames" insert ----- and -----;

Column 6, line 6, delete "servovalve" and insert ----- servo-valve -----;

Column 6, line 39, after "being" insert ---- very ------

Signed and Sealed this

Eighth Day of March 1977

[SEAL]

*Attest:*

RUTH C. MASON
*Attesting Officer*

C. MARSHALL DANN
*Commissioner of Patents and Trademarks*